US009591696B2

(12) United States Patent
Uchida et al.

(10) Patent No.: US 9,591,696 B2
(45) Date of Patent: Mar. 7, 2017

(54) INDUCTION HEATING METHOD

(71) Applicant: Mitsui Engineering & Shipbuilding Co., Ltd., Tokyo (JP)

(72) Inventors: Naoki Uchida, Tamano (JP); Nobutaka Matsunaka, Tamano (JP); Keiji Kawanaka, Tamano (JP); Kazuyoshi Fujita, Tamano (JP); Takahiro Ao, Tamano (JP)

(73) Assignee: Mitsui Engineering & Shipbuilding Co., Ltd., Tokyo (JP)

( * ) Notice: Subject to any disclaimer, the term of this patent is extended or adjusted under 35 U.S.C. 154(b) by 125 days.

(21) Appl. No.: 14/351,489

(22) PCT Filed: Jan. 23, 2013

(86) PCT No.: PCT/JP2013/051346

§ 371 (c)(1),
(2) Date: Apr. 11, 2014

(87) PCT Pub. No.: WO2013/179683

PCT Pub. Date: Dec. 5, 2013

(65) Prior Publication Data

US 2015/0108118 A1 Apr. 23, 2015

(30) Foreign Application Priority Data

Jun. 1, 2012 (JP) ..... 2012-125900

(51) Int. Cl.
*H05B 6/06* (2006.01)
*H05B 6/44* (2006.01)
*H05B 6/10* (2006.01)

(52) U.S. Cl.
CPC ..... *H05B 6/06* (2013.01); *H05B 6/104* (2013.01); *H05B 6/44* (2013.01)

(58) Field of Classification Search
CPC ..... H05B 6/06; H05B 6/44; H05B 6/104
(Continued)

(56) References Cited

U.S. PATENT DOCUMENTS 9,173,251 B2 10/2015 Uchida et al.
2005/0199614 A1* 9/2005 Uchida ..... A45D 20/12 219/662

(Continued)

FOREIGN PATENT DOCUMENTS

EP 2 405 711 A2 1/2012
JP 2004-259665 9/2004

(Continued)

OTHER PUBLICATIONS

Office Action of German Patent Office in the corresponding German application 11 2013 000 253.1dated Sep. 10, 2015, 6 pp. English.

*Primary Examiner* — Thien S Tran
(74) *Attorney, Agent, or Firm* — Juan Carlos A. Marquez; Marquez IP Law Office, PLLC

(57) ABSTRACT

An object is to provide an induction heating method having a high power factor in which when thermal processing is performed through a plurality of heating coils receiving the supply of the current to generate mutual induction. In an induction heating method using an induction heating device that includes self-resonant circuits which feeds currents of equal frequency to a plurality of heating coils receiving the supply of the current to generate mutual induction is connected, wherein adjustment or control is performed to carry out an operation such that a first ratio of a reactance component of a mutual induction impedance to a resistance component of the mutual induction impedance between the adjacent self-resonant circuits and a second ratio of a reac- (Continued)

tance component of a self-impedance to a resistance component of the self-impedance in the self-resonant circuit are made equal to each other.

19 Claims, 10 Drawing Sheets

(58) Field of Classification Search
USPC ..... 219/603, 619, 624, 634, 660, 662, 671; 363/13, 16, 17
See application file for complete search history.

(56) References Cited

U.S. PATENT DOCUMENTS

| | | | | |
|---|---|---|---|---|
| 2011/0157935 | A1* | 6/2011 | Bancroft ..... | H02M 3/3388 363/75 |
| 2013/0140298 | A1 | 6/2013 | Uchida et al. | |

FOREIGN PATENT DOCUMENTS

| | | |
|---|---|---|
| JP | 2005-529475 | 9/2005 |
| JP | 2006-040693 | 2/2006 |
| JP | 2010-245002 | 10/2010 |
| WO | 2012/020652 A1 | 1/2012 |

* cited by examiner

INDUCTION HEATING METHOD

TECHNICAL FIELD

The present invention relates to a technology on a heating method using induction heating, and more particularly relates to a heating method with an induction heating device in which a plurality of heating coils arranged adjacently and which heats an item to be heated.

BACKGROUND ART

It is conventionally known that as a means for performing rapid heating, induction heating is effective. However, since a heating method using induction heating utilizes electromagnetic induction, when a plurality of heating coils each having a power control means (for example, inverter) are arranged adjacently and are operated, mutual induction occurs in each of the heating coils.

In order to avoid the effect of the mutual induction and properly operates the inverter which supplies electricity to each of the heating coils, it is necessary to equalize the frequency of each inverter and synchronize its current (see patent document 1).

The reason why the frequency is equalized is that when the mutual induction of different frequencies occurs, an inverter current and an inverter voltage have a distorted waveform, it is impossible to properly operate the inverter. The reason why the current is synchronized is that when it is assumed that a mutual induction voltage is $j\omega M \cdot I2 \cdot (\cos\theta + j\sin\theta)$, if the coil current is synchronized, $\theta=0$, and the mutual induction voltage is $j\omega M \cdot I2$, with the result that only the reactance component of a mutual induction impedance is left. On the other hand, when the coil current is not synchronized, based on the phase difference of $\theta$, the mutual induction voltage is indicated as $j\omega M \cdot I2 \cdot \cos\theta - \omega M \cdot I2 \cdot \sin\theta$, and the resistance component of the mutual induction impedance appears. Hence, power sharing between the inverters is changed by the mutual induction, and this affects power control on the inverters (co is an angular frequency, M is the mutual inductance caused by the mutual induction between the heating coils arranged adjacently and I2 is the current that is supplied to the heating coils arranged adjacently).

In normal induction heating, a resonance sharpness is 3 to 10, and a coil-to-coil coupling coefficient k is about 0.2. In a series inverter, a coil voltage 10 times as large as an inverter voltage is produced. A voltage about 0.2 times as large as the coil voltage becomes a mutual induction voltage. When $\theta=30$ degrees, the value of the effective part of the mutual induction voltage, that is, the resistance component of the mutual induction impedance, is equal to the inverter voltage, with the result that this significantly affects the power control on the inverter. In order to avoid this effect, it is necessary to perform current synchronization control.

However, even when the current synchronization control is performed, the mutual induction voltage of an reactive part, that is, the voltage caused by the reactance component of the mutual induction impedance is left. This mutual induction voltage is varied by a variation in the coil current on the side that gives the effect. Here, an impedance and a phase caused by mutual induction between a resonant capacitor of a resonant circuit and a self-inductance are varied. Hence, the phase between the voltage and current of an inverter output is significantly varied with a coil current variation by inverter control on the other side or a self-output current variation.

In conventional current synchronization control, since position control is performed on the gate pulse of an inverter to perform current synchronization control, control needs to be significantly performed on an inverter voltage position (=pulse position) so that current synchronization is performed. Since a pulse movement range for the current synchronization control is large, it is disadvantageously impossible to stably provide a rapid response in the current synchronization control, and it is disadvantageously impossible to stably increase the speed of the inverter control.

Even when the current synchronization is performed, the mutual induction voltage of an reactive part is high, the inverter needs to overcome this voltage to produce an output voltage, and since an output phase angle is large at this time and a power factor is poor, an inverter converter capacity disadvantageously needs to be increased. In patent document 2, it is proposed that in order to solve this problem, the mutual induction of the coil and a reverse-polarity inductance are provided between the heating coil and the inverter to improve the power factor.

Moreover, even in this state, the inverter output phase is varied by the current variation on the self-side or the other side. When the mutual induction voltage of the reactive part is high, that is, the reactance component of the mutual induction impedance is large, the inverter output phase reaches about 90 degrees or 90 degrees or more, disadvantageously, a switching loss is increased or reverse power is produced to cause a dangerous operation. When the mutual induction voltage of the effective part is high, that is, the resistance component of the mutual induction impedance is large, the inverter output phase reaches 0 degrees or 0 degrees or less, it is disadvantageously impossible to perform a ZVS (zero voltage switching) operation to increase the switching loss or cause a dangerous operation.

Although the above description has been given using an example of a voltage-type inverter (series resonance), the same problem is present even in a current-type inverter (voltage-type inverter).

RELATED ART DOCUMENT

Patent Document

Patent document 1: Japanese Unexamined Patent Application Publication (Translation of PCT Application) No. 2005-529475

Patent document 2: Japanese Unexamined Patent Application Publication No. 2004-259665

DISCLOSURE OF THE INVENTION

Problems to be Solved by the Invention

In the technology disclosed in the patent documents described above, the current synchronization control is performed, and thus it is possible to operate the inverter under a mutual induction environment. However, as described above, since it is necessary to significantly control, while varying the current value, the pulse position to perform the current synchronization, the following problems are encountered. It is disadvantageously impossible to stably perform rapid response control. When the current value is varied, if the mutual induction of the reactive part is large, the inverter output phase approaches 90 degrees or if the mutual induction of the effective part is large, the inverter output phase approaches 0 degrees, and the power actor is poor, with the result that a dangerous operation is likely to be disadvantageously caused.

Hence, the present invention provides an induction heating method in which when thermal processing is performed through a plurality of heating coils arranged adjacently, even if the current on the self-side or the other side is varied, the variation in the inverter output phase of the mutual induction is small, and it is possible to easily and rapidly perform synchronization control on the coil current and in which when the current is varied, even if the speed of control on the current value is increased, this does not affect the current synchronization control, specifically, the present invention provides a method in which it is possible to achieve ZVS (in the current type, ZCS: zero current switching) and a high power factor by decreasing the output phase variation in the mutual induction inverter and decreasing and uniformizing the phase even if the current on the self-side or the other side is varied.

Then, an induction heating method using an induction heating device that has great efficiency, a high power factor and a high speed response, that is compact and cost-effective and that can achieve uniform heating under a mutual induction environment is established.

Means for Solving the Problem

To solve the above problems, according to the present invention, there is provided an induction heating method using an induction heating device that heats an item to be heated and includes a plurality of self-resonant circuits to which a resonant high-frequency power supply supplying currents of equal frequency to a plurality of heating coils receiving the supply of the current to generate mutual induction is connected, where adjustment or control is performed such that a phase angle between a reactance component and a resistance component of a mutual induction impedance and a phase angle between a reactance component and a resistance component of an impedance in the self-resonant circuit are made equal to each other, and thereafter, the frequency and/or a value of an output current is controlled such that a phase difference of the currents is zero and/or a variation in a phase angle between the output current and an output voltage of the resonant high-frequency power supply is reduced.

Preferably, in the induction heating method having the characteristic described above, adjustment or control is performed such that the phase angle in the mutual induction impedance and the phase angle in the impedance in the self-resonant circuit are reduced so as to highly efficiently operate the induction heating device.

Preferably, in the induction heating method having the characteristic described above, a first phase angle which is a phase between coil currents generating a mutual induction voltage and mutual induction is reduced by adding a reverse coupling inductance to an electricity feed line to the heating coils arranged adjacently, adjustment or control is performed such that a second phase angle which is a phase between a combination voltage of the self-resonant circuit and the current supplied to the heating coil is made equal to the first phase angle and consequently, the phase angle between the output current and the output voltage of the resonant high-frequency power supply is reduced.

To solve the above problems, according to the present invention, there is provided an induction heating method using an induction heating device that heats an item to be heated and includes a plurality of self-resonant circuits to which a resonant high-frequency power supply supplying currents of equal frequency to a plurality of heating coils receiving the supply of the current to generate mutual induction is connected, where adjustment or control is performed to carry out an operation such that a first phase angle which is a phase between coil currents generating a mutual induction voltage and mutual induction and a second phase angle which is a phase between a combination voltage of the self-resonant circuit and the current supplied to the heating coil are made equal to each other.

Furthermore, to solve the above problems, according to the present invention, there is provided an induction heating method using an induction heating device that heats an item to be heated and includes a plurality of self-resonant circuits to which a resonant high-frequency power supply supplying currents of equal frequency to a plurality of heating coils receiving the supply of the current to generate mutual induction is connected, where adjustment or control is performed to carry out an operation such that a first ratio of a reactance component of a mutual induction impedance to a resistance component of the mutual induction impedance between the adjacent self-resonant circuits and a second ratio of a reactance component of a self-impedance to a resistance component of the self-impedance in the self-resonant circuit are made equal to each other.

In the induction heating method having the characteristic described above, the adjustment or the control performed such that the first phase angle and the second phase angle are made equal to each other or the first ratio and the second ratio are made equal to each other can be carried out by adjustment or control on the impedance of the self-resonant circuit.

In the induction heating method having the characteristic described above, the adjustment or the control performed such that the first phase angle and the second phase angle are made equal to each other or the first ratio and the second ratio are made equal to each other can be carried out by adjustment or control on the frequency of the current supplied to the heating coil.

In the induction heating method having the characteristic described above, when a gate pulse is supplied to the resonant high-frequency power supply in each of the self-resonant circuits, the gate pulse is output such that a phase difference of the gate pulse is zero or close to a predetermined phase difference, and the induction heating device can be operated.

In the induction heating method having the characteristic described above, the resonant high-frequency power supply in each of the self-resonant circuits is a voltage-type high-frequency power supply, and the induction heating device can be operated such that a phase difference of an output voltage of the voltage-type high-frequency power supply is zero.

In the induction heating method having the characteristic described above, the resonant high-frequency power supply in each of the self-resonant circuits is a current-type high-frequency power supply, and the induction heating device can be operated such that a phase difference of an output voltage of the current-type high-frequency power supply is zero.

Preferably, in the induction heating method having the characteristic described above, the gate pulse is output such that when the resonant high-frequency power supply is started up, a phase difference of the gate pulse is zero or close to a predetermined phase difference, and thereafter, the gate pulse supplied to the resonant high-frequency power supply is controlled such that a phase of the current supplied to each of the heating coils is made to coincide with a phase of a reference signal.

Preferably, in the induction heating method having the characteristic described above, when the resonant high-frequency power supply is started up such that the phase difference of the gate pulse is zero, the gate pulse is controlled so as to have a predetermined phase or a time corresponding to the phase with respect to a current synchronization reference position determined based on the reference signal.

Preferably, in the induction heating method having the characteristic described above, after the starting up of the resonant high-frequency power supply, a zero-crossing position of the current supplied to each of the heating coils is detected, and when the zero-crossing position of each current is displaced from the current synchronization reference position, the gate pulse position is controlled such that a phase difference between the zero-crossing position of each current and the current synchronization reference position is zero.

Preferably, in the induction heating method having the characteristic described above, a permissible phase angle range which is a permissible range of a phase angle between the output voltage and the output current is determined, and the frequency and/or a value of the output current is controlled such that the phase angle between the output voltage and the output current falls within the permissible phase angle range.

Preferably, in the induction heating method having the characteristic described above, while the frequency is being controlled, the gate pulse position is controlled such that a phase difference between the currents is zero.

Preferably, in the induction heating method having the characteristic described above, the frequency is controlled within a range of values higher than a resonant frequency of the self-resonant circuit.

Preferably, in the induction heating method having the characteristic described above, a current synchronization control range limiter which is a limit range of a phase difference between the gate pulse position and the current synchronization reference position is determined, and the output current is controlled such that the gate pulse position falls within a range of the current synchronization control range limiter.

Preferably, in the induction heating method having the characteristic described above, a reverse coupling inductance is connected to each of electricity feed lines to the heating coils which are arranged adjacently to generate mutual induction by the supply of the current such that the first ratio or the first phase angle is reduced.

In the induction heating method having the characteristic described above, a reactance component of the reverse coupling inductance can be adjusted or controlled such that the first ratio and the second ratio or the first phase angle and the second phase angle are made equal to each other.

In the induction heating method having the characteristic described above, the first ratio or the first phase angle is adjusted to be equal to a predetermined target value, and the second ratio or the second phase angle can be made equal to the target value.

In the induction heating method having the characteristic described above, the reactance component of the mutual induction impedance is varied by varying a coupling coefficient in the reverse coupling inductance so that the first ratio or the first phase angle can be adjusted.

Preferably, in the induction heating method having the characteristic described above, the self-inductance of the reverse coupling inductance is adjusted such that the second ratio or the second phase angle is adjusted to be a target value, and the coupling coefficient of the self-inductance is adjusted such that the first ratio or the second ratio is adjusted to be a target value.

Furthermore, preferably, in the induction heating method having the characteristic described above, the inductance or the capacitance in the self-resonant circuit is adjusted such that the second ratio or the second phase angle is adjusted.

Preferably, in the induction heating method having the characteristic described above, the phase, the phase angle and the phase difference are converted into a time corresponding to the frequency, and are set, adjusted or controlled.

Furthermore, preferably, in the induction heating method having the characteristic described above, the detection, the setting and the control are performed through a computer program or a programmable device.

BEST MODE FOR CARRYING OUT THE INVENTION

Embodiments according to the induction heating method of the present invention will be described in detail below with reference to accompanying drawings.

In self-resonant circuits that are individually connected to at least two heating coils and produce mutual induction by supplying current to each of the heating coils, opposite power to the output of an inverter as a resonant high-frequency power supply is input into each of the self-resonant circuits by the effect of a mutual induction voltage. Hence, the phases of an output voltage and an output current are significantly varied. When the phase angle is excessively decreased, it is impossible to perform voltage control and current control, such as ZVS (zero voltage switching: at the time when a voltage-type inverter is used) and ZCS (zero current switching: at the time when a current-type inverter is used), with the result that it is difficult to control the output power. On the other hand, when the phase angle is excessively increased, the switching loss of each inverter is increased, and thus the energy efficiency is extremely degraded. The phase difference between the both sometimes exceeds 90 degrees, and thus it may be impossible to perform the control. Hence, the phase angles of the current and the voltage can be subjected to the ZVS control and the ZCS control, and the minimizing of the variation and the value leads to a stable and high efficient operation.

Figure 1:
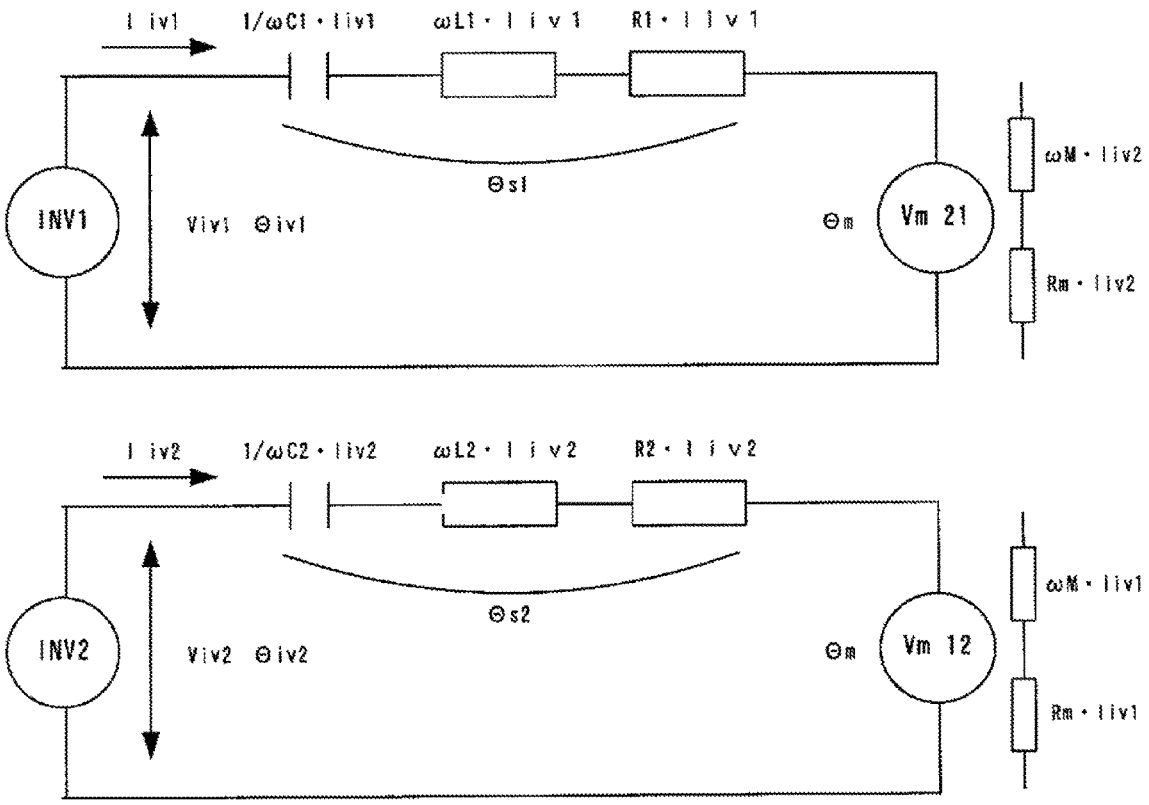
FIG. 1 An equivalent circuit diagram of a self-resonant circuit of a series resonant circuit using a voltage-type inverter.

Here, in two self-resonant circuits shown in FIG. 1 and in a state of mutual induction, output voltages Viv1 and Viv2 from inverters necessary to obtain power for heating an item to be heated are those obtained by combing voltages (Vs1 and Vs2) of the self-resonant circuits and mutual induction voltages (Vm21 and Vm12). Here, the self-resonant circuit refers to a circuit that is formed with a heating coil, a resonant capacitor, wiring paths and the like. In such a circuit system, with consideration given to mutual induction, the output voltages Viv1 and Viv2 from the inverters can be expressed by formulas 1 and 2.

$$Viv2=Vs1+Vm21 \quad \text{(Formula 1)}$$

$$Viv2=Vs2+Vm12 \quad \text{(Formula 2)}$$

In formulas 1 and 2, when with respect to the phase angle θ, it is assumed that θs1=θs2=θm=θ, it is possible to obtain formulas 3 and 4.

$$\begin{aligned} Vs1 &= Iiv1 \times Z1 \\ &= Iiv1|Z1| \times (\cos\theta m + j\sin\theta m) \end{aligned} \quad \text{(Formula 3)}$$

$$\begin{aligned} Vm21 &= Iiv2 \times Zm \\ &= Iiv2|Zm| \times (\cos\theta m + j\sin\theta m) \end{aligned} \quad \text{(Formula 4)}$$

In formulas 3 and 4, since the phase angles θ are equal to each other, it is found that the vector directions of the Viv1 and Viv2 coincide with each other. Unser such a control environment (the control environment where θm, θs1 and θs2 are equal to each other), even if mutual induction occurs, this effect causes only a variation in impedance Zm or if the mutual induction voltage Vm is increased or decreased, the phase angles of the output voltage and the output current of the inverter are not varied.

Hence, the phase angle (the first phase angle θm) of the mutual induction voltage Vm21 for the self-resonant circuit on one side with respect to the output current Iiv2 from the inverter Inv2 on the other side is made equal to the phase angle (the second phase angle θs1 (the phase angle of a combination voltage Vs2 of the self-resonant circuit on the other side with respect to the output current Iiv2 from the inverter Inv2 on the other side is θs2) of a combination voltage Vs1 of the self-resonant circuit on the one side with respect to the output current Iiv1 from the inverter Inv1 on the one side, and thus the phases of the output voltages Viv and the output currents Iiv of the inverters in all the self-resonant circuits in a relationship of mutual induction can be made to coincide with each other.

Preferably, in order for the phase angles θs1, θs2 and θm to be made equal to each other, the frequencies of the output currents from the inverters are made equal to each other, and the gate pulses of the output voltages of the inverters are synchronized. This is because the output voltage is synchronized in the circuit where the frequencies of the output currents are made equal to each other, it is possible to inevitably synchronize the output currents Iiv1 and Iiv2.

Hereinafter, a specific example of the circuit configuration will be shown in FIG. 2, and a description will be given of the realization of the above method with respect to FIG. 2.

Figure 2:
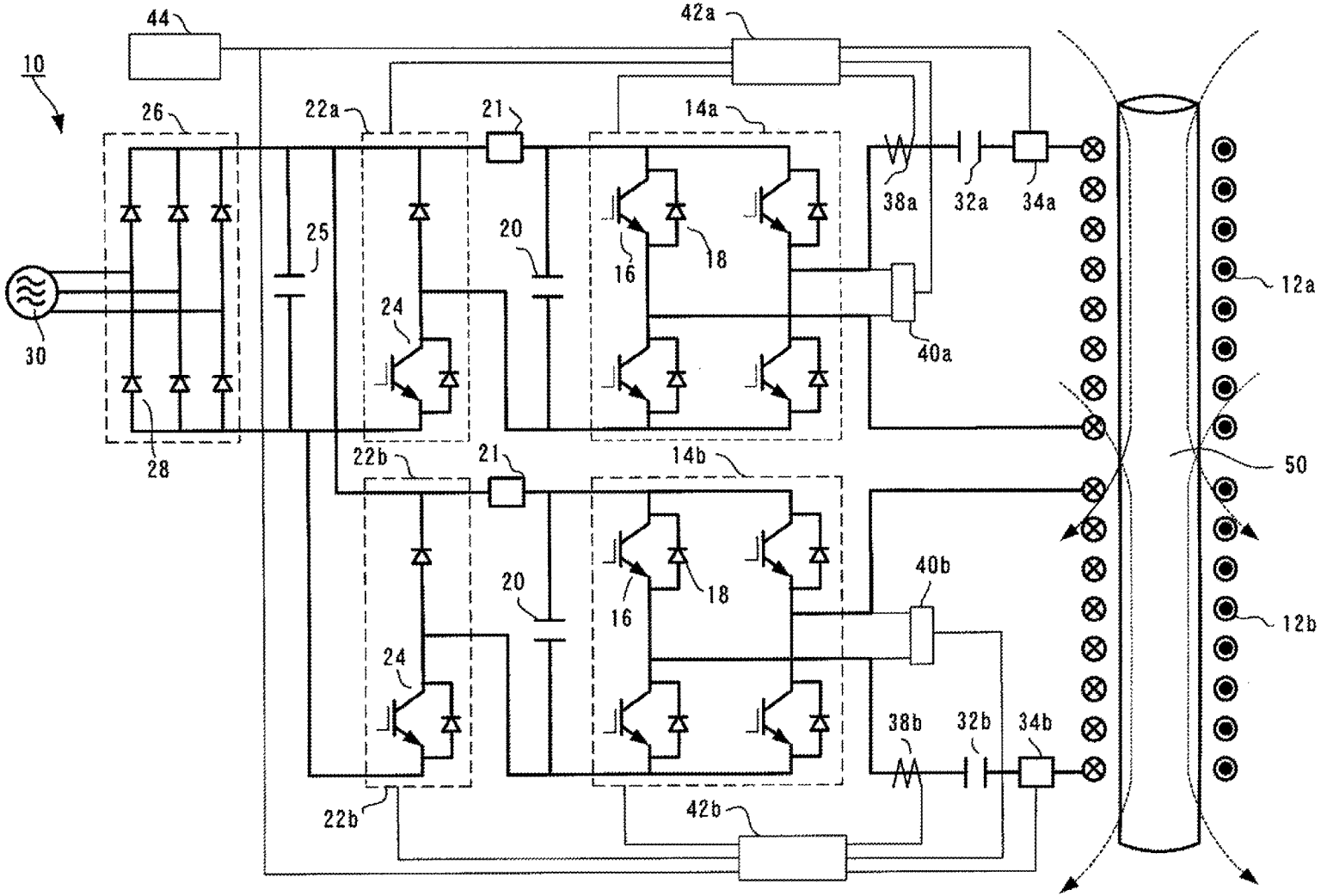
FIG. 2 A diagram showing the configuration of an induction heating device including the self-resonant circuit of the series resonant circuit using the voltage-type inverter.

An induction heating device 10 shown in FIG. 2 is formed basically with heating coils 12*a* and 12*b*, inverters (reverse conversion circuit) 14*a* and 14*b*, chopper circuits 22*a* and 22*b*, a converter (forward conversion circuit) 26, a power supply portion 30 and control circuits 42*a* and 42*b*.

The induction heating device 10 shown in FIG. 2 is configured by connecting a circuit consisting of the chopper circuits 22*a* and 22*b*, the inverters 14*a* and 14*b* and heating coils 12*a* and 12*b* in parallel to the converter 26, which will be described in detail later. Hence, the induction heating device 10 of the present embodiment has a plurality of self-resonant circuits that can perform power control individually.

The heating coils 12*a* and 12*b* are coils to which the inverters 14*a* and 14*b* capable of supplying a high-frequency current are connected. In the present embodiment, a plurality of (two in the example shown in FIG. 2) heating coils 12*a* and 12*b* are arranged near a single inductively heated member 50. In the arrangement configuration described above, when power is fed to the coils, mutual induction occurs between the heating coils 12*a* and 12*b* arranged adjacently.

The inverters 14*a* and 14*b* used in the induction heating device 10 shown in FIG. 2 are voltage-type inverters. Between the heating coils 12*a* and 12*b* and the inverters 14*a* and 14*b*, resonant capacitors 32*a* and 32*b* are connected in series, and series resonant circuits are formed between them. Hence, it can be said that the induction heating device 10 shown in FIG. 2 forms a plurality of (two) self-resonant circuits.

The inverters 14*a* and 14*b* form a single-phase full-bridge inverter. As a switching element, an IGBT 16 is used, and a diode 18 is connected in anti-parallel so that a load current is subjected to commutation. In the stage preceding the bridge circuit, a smoothing capacitor 20 and a smoothing coil 21 for smoothing a direct-current voltage are provided.

The chopper circuits 22*a* and 22*b* serve to chop, with an IGBT 24 that is a switching element, a direct-current voltage that is output from the converter 26 and that is a constant voltage to vary the average voltage that is input to the inverters 14*a* and 14*b*. Between the chopper circuits 22*a* and 22*b* and the converter 26, a smoothing capacitor 25 is provided.

The converter 26 is formed with a three-phase diode bridge using diodes 28. The converter 26 serves to convert a three-phase alternating current supplied from the power supply portion 30 into a direct current and to supply it to the chopper circuits 22*a* and 22*b*.

The control circuits 42*a* and 42*b* serve to adjust, based on an output voltage and an output current from the inverters 14*a* and 14*b* that are detected, the impedance of each of the self-resonant circuits, and to feed a gate pulse for control to the inverters 14*a* and 14*b* and the chopper circuits 22*a* and 22*b*. The gate pulse fed to the inverters 14*a* and 14*b* is a signal for controlling timing at which the IGBT 16, which is a switching element, is switched, and the phases of the output voltages Viv are controlled.

A reference signal generation portion 44 is connected to the control circuits 42*a* and 42*b*. The reference signal generation portion 44 generates the reference waveforms of the output currents supplied to the heating coils 12*a* and 12*b*. Then, the reference signal generation portion 44 uses the generated reference waveforms as the reference signals and feeds them to the control circuits 42*a* and 42*b*. The control circuits 42*a* and 42*b* compares the phases of the reference waveforms (for example, comparing the phases assuming that the zero-crossing position of the reference waveform is a current synchronization reference position), determines the phase difference of the both and generates the gate pulses fed to the inverters 14*a* and 14*b* and the like.

On the output side of the inverters 14*a* and 14*b*, current detection means 38*a* and 38*b* that detect the output currents and voltage detection means 40*a* and 40*b* that detect the output voltages are provided, and the detection values are input to the control circuits 42*a* and 42*b*.

In the present embodiment, impedance adjustment means 34*a* and 34*b* are provided in series with the heating coils 12*a* and 12*b*. The impedance adjustment means 34*a* and 34*b* are circuits that include means for varying an inductance and a capacitance such as a variable inductance and a variable capacitance, and serve to vary, based on adjustment signals from the control circuits 42*a* and 42*b*, the self-inductances L1 and L2 and the capacitances C1 and C2 of the self-resonant circuits.

In the induction heating device 10 configured as described above, the gate pulses fed to the inverters 14*a* and 14*b* are synchronized (although the phases of the gate pulses preferably coincide with each other, in the present embodiment, bringing the phase difference of the gate pulses close to zero is included), and the output voltages Viv1 and Viv2 between the self-resonant circuits are synchronized (although the phases of the output voltages preferably coincide with each other, in the present embodiment, bringing the phase difference of the output voltages close to zero is included), with the result that it is possible to perform the operation as if the output currents Iiv1 and Iiv2 are synchronized (although the phases of the output currents preferably coincide with each other, in the present embodiment, bringing the phase difference of the output currents close to zero is included). Hence, it can be said that it is possible to perform at least part of the effects of the present invention. In the control state described above, even if chopper control is rapidly performed to vary the current value, it is possible to stably keep the state of the current synchronization. Thus, it is possible to perform rapid-response, safety and simple control.

In the example shown in FIG. 2, a plurality of inverters 14*a* and 14*b* are connected in parallel to one converter 26. This is because in this configuration, it is possible to individually perform power control while reducing the size and cost of the power supply circuit. However, needless to say, the converter 26 and the power supply portion 30 may be individually connected to the inverters 14*a* and 14*b*.

Figure 3:
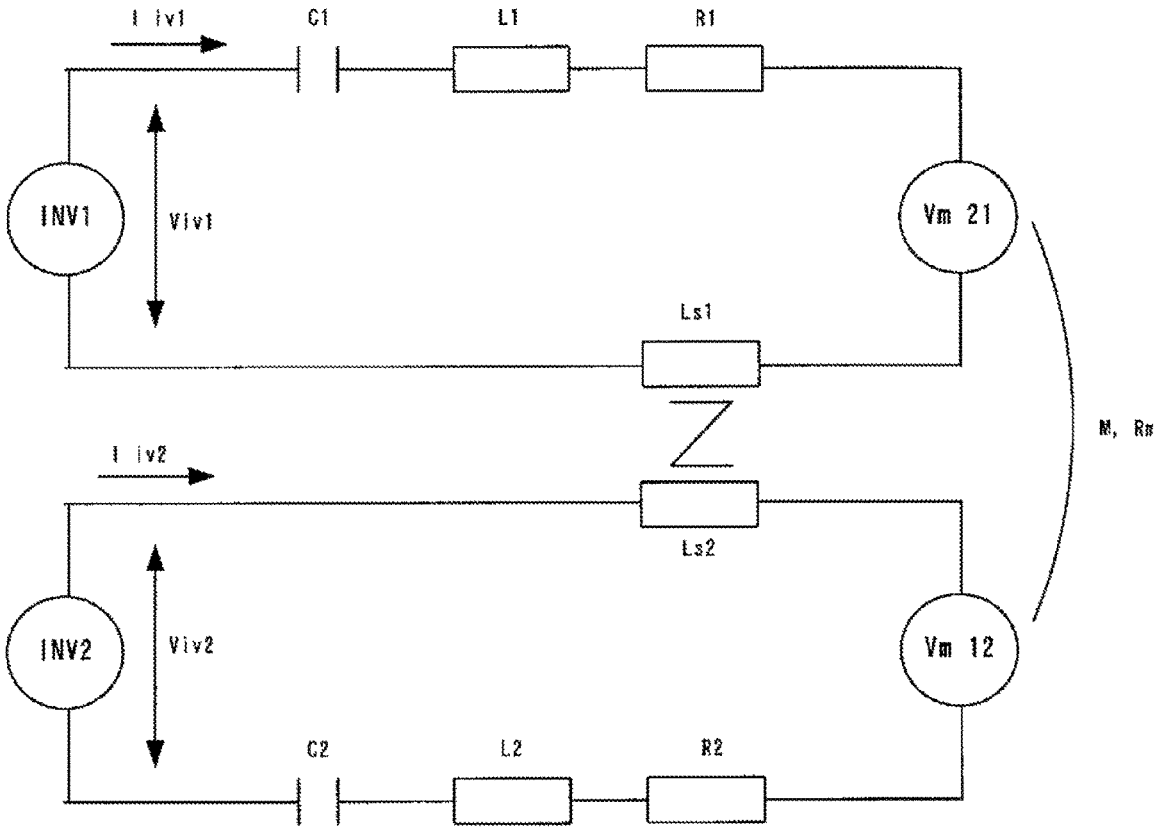
FIG. 3 An equivalent circuit diagram of the self-resonant circuit that forms the series resonant circuit using the voltage-type inverter and that includes a reverse coupling inductance.
Figure 4:
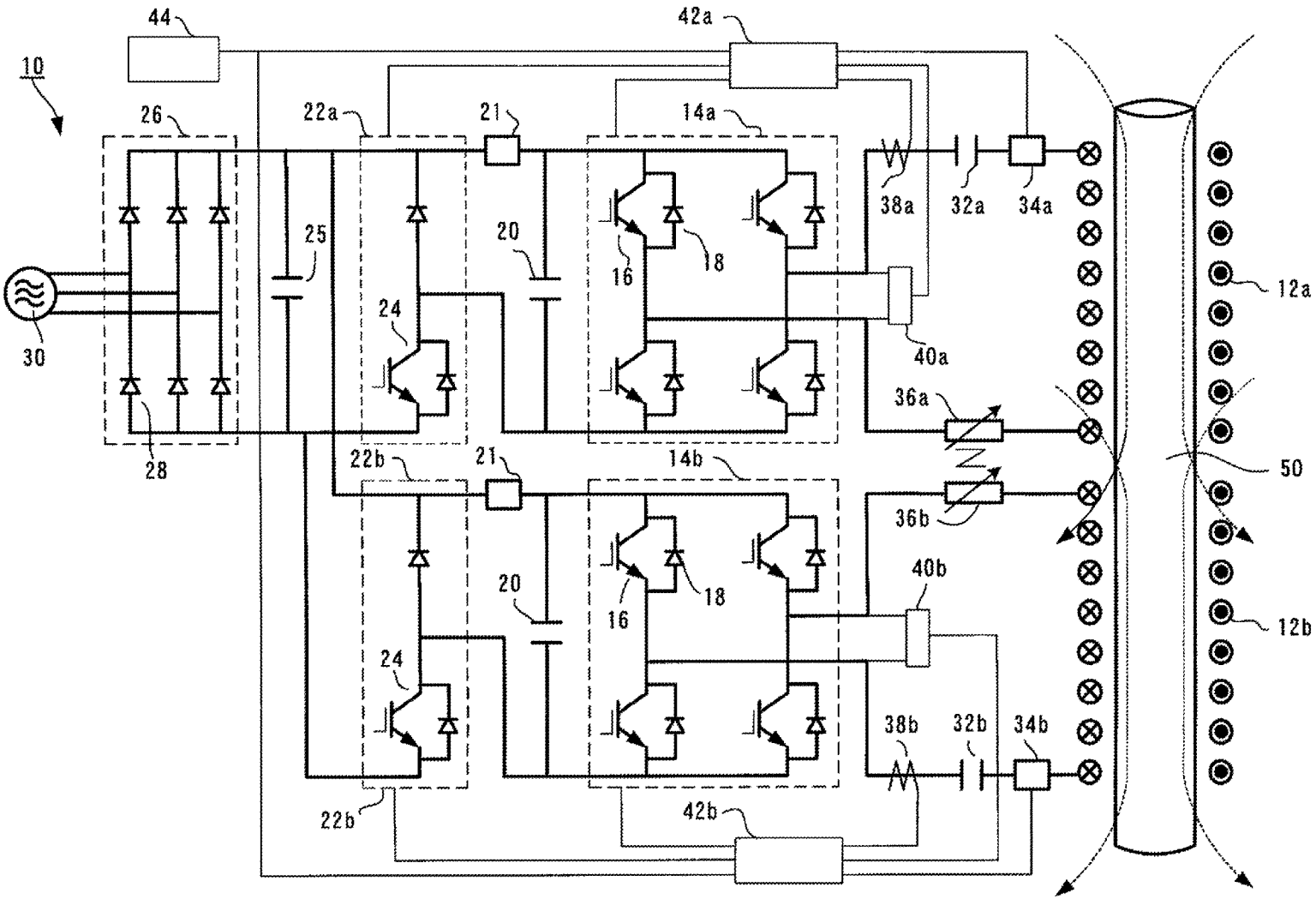
FIG. 4 A diagram showing the configuration of the induction heating device including the self-resonant circuit that forms the series resonant circuit using the voltage-type inverter and that includes the reverse coupling inductance.

In the induction heating device 10 of the present embodiment, as shown in FIG. 4, reverse coupling inductances 36*a* and 36*b* are preferably provided in series with the heating coils 12*a* and 12*b*. The reverse coupling inductances 36*a* and 36*b* are coils that are configured to produce a mutual inductance (M) caused by mutual induction between the heating coils 12*a* and 12*b* and a reverse-polarity mutual inductance (−m), and can be indicated by $m=k2\times\sqrt{(Ls1\times Ls2)}$ (k2 is a coupling coefficient). Ls1 and Ls2 are the self-inductances of the reverse coupling inductances 36*a* and 36*b* (FIG. 3 shows an equivalent circuit diagram to the induction heating device shown in FIG. 4). Hence, the reverse coupling inductances 36*a* and 36*b* are arranged closely between the adjacent circuits. Since the reactance component XLm of a mutual induction impedance Zm in a case where the reverse coupling inductances 36*a* and 36*b* are provided is indicated by ωM−ωm, −m is varied, and thus it is possible to vary the ratio of the resistance component Rm to the reactance component XLm in the mutual induction impedance Zm. When the mutual induction impedance is indicated by $|Zm|=\sqrt{(Rm^2+XLm^2)}$, a ratio (the first ratio) indicated by XLm/Rm can be decreased as compared with a case where the reverse coupling inductances 36*a* and 36*b* are not provided. Here, since the first phase angle θm can be indicated by a tan ωM/Rm, as the addition of −m decreases the value of ωM, θm is also decreased. Hence, when it is assumed that θm=θs1=θs2, it is possible to enhance the power factor.

Therefore, with the configuration described above, it is possible to perform the operation at the minimum phase angel that can be achieved by the ZVS. Hence, the control described above is applied to the induction heating device configured as described above, and thus it is possible to highly efficiently, rapid-response, safety and simple control.

In any of the embodiments described above, it is assumed that θm (the first phase angle), θs1 and θs2 (the second phase angle) are made equal to each other, and thus the phases of the output voltages from the inverters are synchronized and the phases of the output currents are also synchronized. However, since in actuality, the phases of the output currents are slightly varied, it may be impossible to make the phases of the output currents coincide with each other only by the control on the phase angle through the adjustment of the position of the gate pulse. In this case, the adjustment of the frequency and the adjustment of the current value are combined to synchronize the phases of the output currents, and thus it is possible to rapidly and stably perform high-accurate control on the current value.

Preferably, in the control described above, with respect to the phases of the output currents and the output voltages, it is assumed that the zero-crossing position of the reference waveform is the current synchronization reference position and the current synchronization reference position is a base point, with the result that the phase angle is determined. For example, when it is assumed that the phase angle of the mutual induction voltage Vm with respect to the mutual induction current (for example, Iiv2) in synchronization with the current synchronization reference position is θm, the phase angle is determined to be the phase angel θg of the output voltage Viv from the inverter with respect to the current synchronization reference position. In the present embodiment, the output position of the gate pulse fed when the inverter is started up is determined such that θm and θg described above are made equal to each other.

By performing the operation described above, even if in each self-resonant circuit, the phase difference of the current phase angles at the time of starting is zero or is produced, it is possible to decrease it. For example, in the example shown in FIG. 5(A), even when θm and θg1 are made equal to each other, Δθiv1 is produced as the phase angle between the zero-crossing position of the output current Iiv1 of the inverter 14*a* and the current synchronization reference position.

Figure 5:
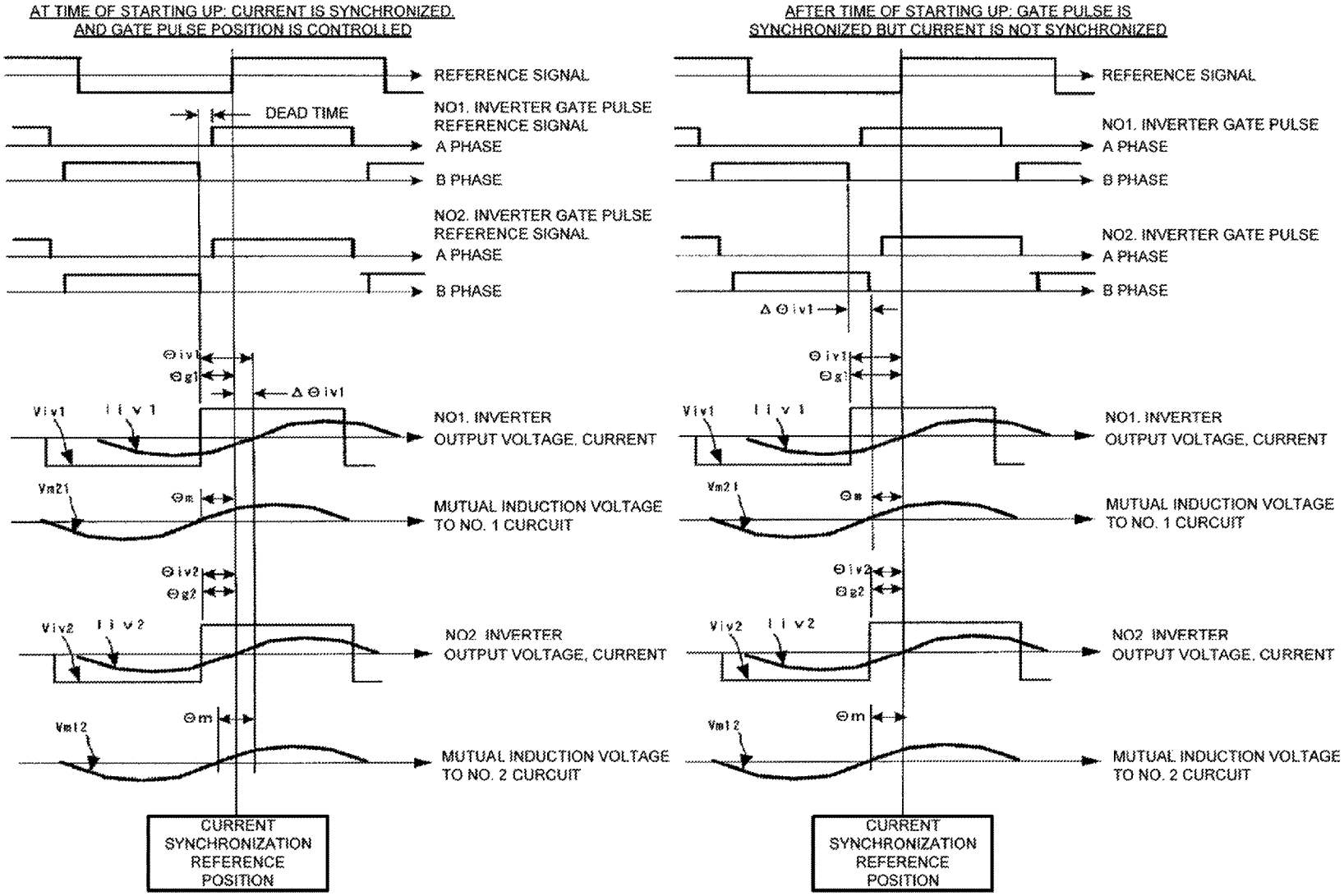
FIG. 5(A) is a waveform diagram showing an example of a case where even when the gate pulse generation positions of inverter output voltages are made to coincide with each other, the zero-crossing position of an output current is displaced from a current synchronization reference position.
FIG. 5(B) is a waveform diagram showing an example of how current synchronization is completed by slightly displacing the gate pulse generation position.

However, in the control described above, since the phase control is previously performed when the inverter is started up, the amount of displacement (the phase angle Δθiv1) from the current synchronization reference position is low. Hence, even when the current synchronization control is performed, as shown in FIG. 5(B), it is possible to synchronize the current phases in a small pulse movement range (Δθg1), with the result that it is possible to increase the response speed at the time of the current synchronization control. Here, a current synchronization control range limiter is preferably determined as the limit range of the phase angel θg1 between the gate pulse position and the current synchronization reference position. The current synchronization control range limiter is a limiter for reducing a control failure caused when the gate pulse position is excessively moved away from or excessively moved close to the current synchronization reference position, and in a range where satisfactory control can be performed, a lower limit value and an upper limit value are determined. When the gate pulse position is varied outside the current synchronization control range limiter, the output current of the inverter is increased to reduce the variation based on the mutual induction current.

In the control described above, even when with respect to the control on the output power from each inverter, the prevention of the effect of the mutual induction, a high speed and high accuracy are realized, if the output phase angle θiv (the phase angle between the voltage Viv and the current Iiv) of the inverter does not fall within a proper range, it is likely that the power factor is degraded and it is difficult to perform the control. In other words, when the output phase angle θiv is excessively large, the switching loss is increased, and the power factor is degraded whereas when the output phase angle θiv is excessively small, it is difficult to perform the ZVS control. Hence, for the output phase angle θiv, a permissible value (permissible phase angle range) of the phase angle is preferably determined within a range where the ZVS control can be performed and a high power factor can be acquired. The control is performed such that the output phase angle θiv is located within the permissible phase angle range, and thus it is possible to perform the ZVS control and the high power factor operation.

The phase angle θiv of each inverter is controlled by the frequency adjustment and/or the adjustment of the output current. Specifically, the control is preferably performed by the following method.

Figure 6:
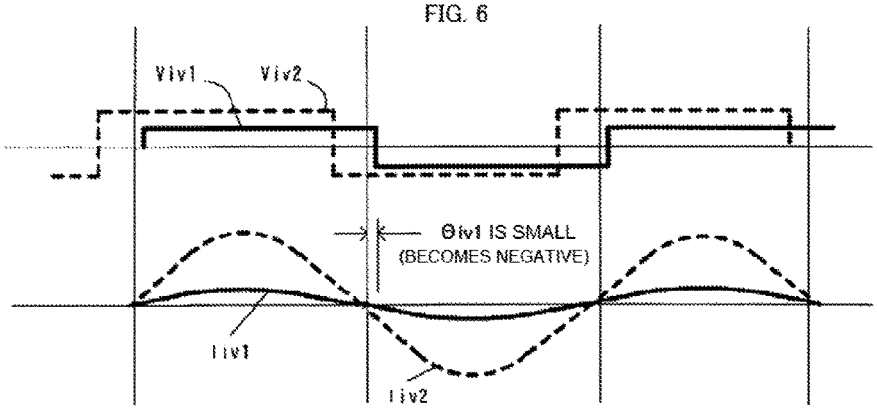
FIG. 6 A diagram showing an example of a case where it is necessary to adjust the phase angle θiv1 between the output voltage Viv1 and the output current Iiv1 of the inverter.
Figure 7:
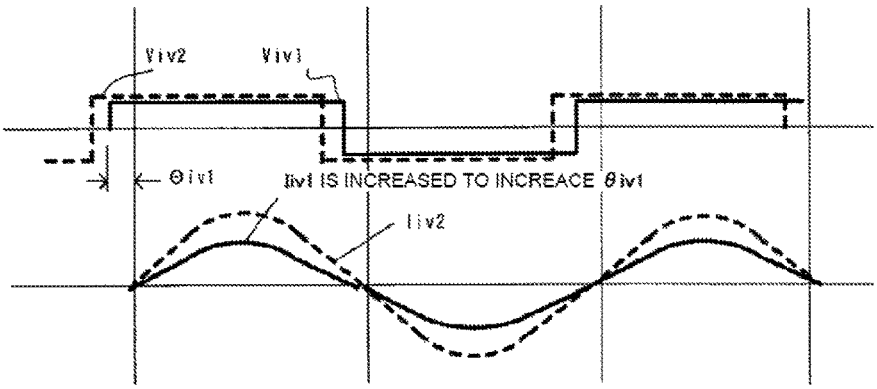
FIG. 7 A diagram showing an example where the phase angle θiv1 is improved by adjusting the phase angle θiv1 between the output voltage Viv1 and the output current Iiv1 of the inverter.

For example, when as shown in FIG. 6, the phase angle θiv of the output of the inverter 14*a* that is a control target is small (for example, 20° or less: minus in FIG. 6), and the value of the output current Iiv1 is low (for example, 15% or less) with respect to the specified current value (for example, the average value of the output currents from a plurality of inverters), the output current Iiv1 is increased. When the output current of the inverter 14*a* that is a control target is lower than the specified current value, the effect of the mutual induction voltage is increased, and the phase angle θiv between the output voltage and the output current of the inverter is decreased. Hence, the output current is increased, and thus the effect of the mutual induction voltage is decreased, with the result that as shown in FIG. 7, it is possible to increase the phase angle θiv.

Figure 8:
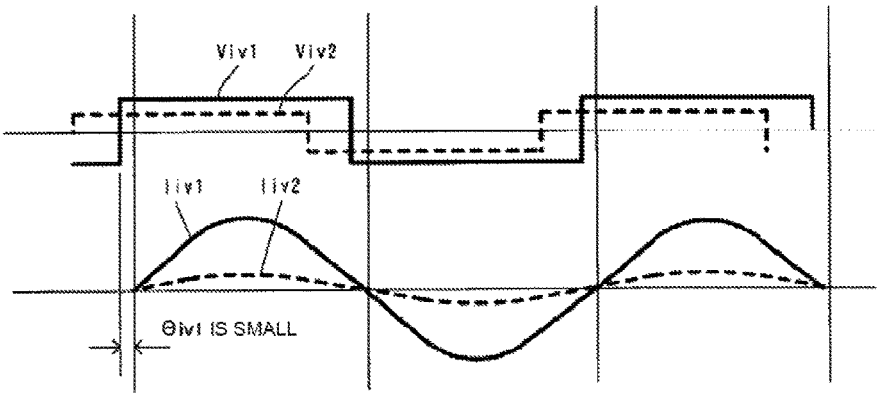
FIG. 8 A diagram showing an example of the case where it is necessary to adjust the phase angle θiv1 between the output voltage Viv1 and the output current Iiv1 of the inverter.

On the other hand, even if the phase angle is small, when as shown in FIG. 8, the value of the output current Iiv1 is higher than a predetermined ratio with respect to the current of the specified value (for example, 15% or more), the frequency of the output current is increased. In this way, it is possible to increase the phase angle θiv. By performing the control described above, it is possible to reliably perform the ZVS control.

Figure 9:
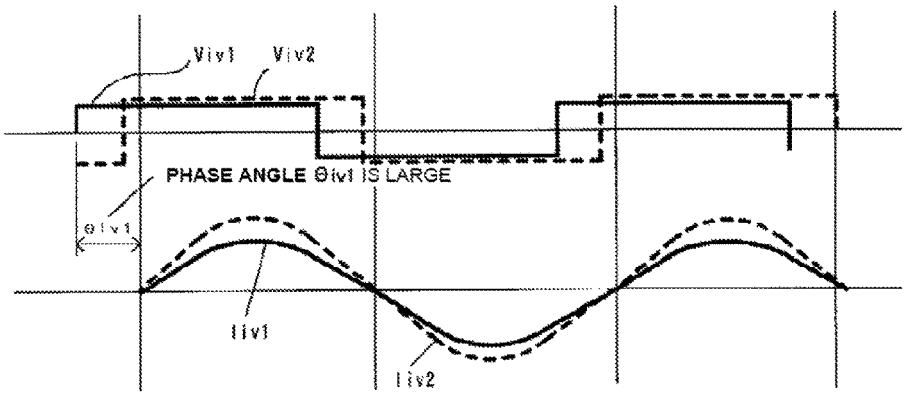
FIG. 9 A diagram showing an example of the case where it is necessary to adjust the phase angle θiv1 between the output voltage Viv1 and the output current Iiv1 of the inverter.

On the other hand, when as shown in FIG. 9, the phase angle θiv is large (for example, 45° or more), and the value of the output current Iiv1 is equal to or more than 50% of the specified value, the frequency is reduced, and the phase angle θiv is decreased. With the control described above, it is possible to reduce the switching loss in the inverter 14*a* and enhance the power factor. The frequency adjustment is performed on all the inverters in the same manner. Hence, even if an inverter having a large phase angle θiv is present, and thus it is necessary to reduce the frequency, when a control signal indicating that the frequency of another inverter is increased is output, the frequency is preferentially increased. This is because the ZVS control is preferentially performed so as to highly accurately control the output power of the inverter.

The control on the frequency in the control described above is performed within a range of values higher than the resonant frequency in each self-resonant circuit. In formulas 1 and 2, when the frequency of the output current is lower than a self-resonant point, θs1 and θs2 become minus. Hence, the output voltage/output current become negative, and thus it is impossible to perform the control.

When the control described above is performed, a phase angle limiter for determining the lower limit value and the upper limit value of the phase angle θs and a current value limiter for determining the lower limit value and the upper limit value of the output current Iiv are preferably determined. This is because it is possible to determine a control pattern by comparing each limiter value and the detection value.

In other words, when θs1 of the inverter 14*a* that is a control target is the lower limit value of the phase angle limiter or less (for example, 18°), and the value of the output current Iiv1 is the lower limit value of the current value limiter or less (for example, 15%), the control is performed so as to increase the output current Iiv1 of the inverter 14*a*. Moreover, when θs1 is the lower limit value of the phase angle limiter or less, and the value of the output current Iiv1 is the lower limit value of the current value limiter or more, the control is performed so as to increase the frequency of the output current Iiv1. Furthermore, when θs1 is the upper limit value of the phase angle limiter or more (for example, 45°), and the value of the output current Iiv1 is 50% or more, the control is performed so as to decrease the frequency of the output current Iiv1.

When the gate pulse position is varied and the current synchronization control is performed, a gate pulse variable range is determined, and the current is increased when it falls within this range. For example, in formula 1, when Iiv1<Iiv2, the phase angle θiv1 between the output voltage and the output current of the inverter approaches θm. In this case, even if the frequency of the output current is increased, θiv1 is not increased. Even if the gate pulse position is varied to change the current zero-crossing position in order to achieve current synchronization, it is impossible to do the current synchronization. Hence, in such a case, it is necessary to increase the current.

A second embodiment according to an induction heating method using the induction heating device 10 of the embodiment described above will now be described. In the present embodiment, the target on which control is performed through the control circuits 42*a* and 42*b* is different.

Specifically, control is performed such that the ratios of the resistance component to the reactance component of the impedance within the circuit are made equal to each other. This is because when the ratios are equal to each other, even if the magnitudes of the impedance |Z| are different, θ is not varied.

Hence, in order for θs1, θs2 and θm to be made equal to each other, the ratio of the resistance component (for example, R1 in the self-resonant circuit on one side and R2 in the self-resonant circuit on the other side) to the reactance component (for example, |XL1−XC1| in the self-resonant circuit on one side and |XL2−XC2| in the self-resonant circuit on the other side) of the impedance (Z1 and Z2) in the self-resonant circuit and the ratio of the resistance component (for example, Rm) to the reactance component (for example, XLm) of the mutual induction impedance (Zm) are preferably adjusted or controlled.

For example, in the induction heating device 10 configured as shown in FIG. 4, the impedance Z1 and the mutual induction impedance Zm of the self-resonant circuit can be expressed by:

$$Viv1=Iiv1\times|Z1|x(\cos\theta1+j\sin\theta1)+Iiv2\times Zm\times(\cos\theta+j\sin\theta m) \quad \text{Formula 5}$$

$$\Theta=\theta1=\theta2=\theta m \quad \text{Formula 6}$$

Hence, in order for the ratio of the reactance component to the resistance component of the mutual induction impedance Zm (=ZLm) (the first ratio) and the ratio of the reactance component to the resistance component of the self-impedance Z1 (Z2) in the self-resonant circuit (the second ratio) to be made equal to each other, formula 7 is preferably made to hold true.

$$Viv1=(Iiv1\times|Z1|+Iiv2\times|Zm|)\times(\cos\Theta+j\sin\Theta) \quad \text{Formula 7}$$

It can be found from formula 7 that formula 7 holds true by varying Ls1 or Ls2 or varying the frequency and thereby varying ω.

Formula 7 is made to hold true, and the gate pulse fed from the control circuit is synchronized with the inverter of each self-resonant circuit where the phase angles of the output voltage Viv and the output current Iiv are made equal to each other (the gate pulse is emitted at the same timing), and thus the phases of the output voltage Viv1 from the inverter 14*a* and the output voltage Viv2 from the inverter 14*b* are synchronized with each other. As described above, when the phases of the individual output voltages are synchronized with each other, the phases of the output currents are inevitably synchronized with each other.

In the embodiment described above, the impedance adjustment means 34*a* and 34*b* are provided, and thus the impedance ratio is controlled in real time. However, the impedance ratio can be previously adjusted as a setting value. Even in this configuration, it is possible to reduce the variation in the phase angle of the output voltage Viv and the output current Iiv caused by the effect of mutual induction.

Hence, when the gate pulses fed to the inverters 14*a* and 14*b* are synchronized with each other, it is possible to perform the operation as if the output voltages Viv1 and Viv2 between the self-resonant circuits are synchronized with each other and the output currents Iiv1 and Iiv2 are also synchronized with each other. Therefore, it can be said that it is possible to perform at least part of the effects of the present invention.

In the embodiment discussed above, the description has been given of the self-resonant circuit, using the series resonant circuit with the voltage-type inverter. However, the self-resonant circuit to which the induction heating method of the present invention can be applied may be the one shown in FIG. 11.

Figure 11:
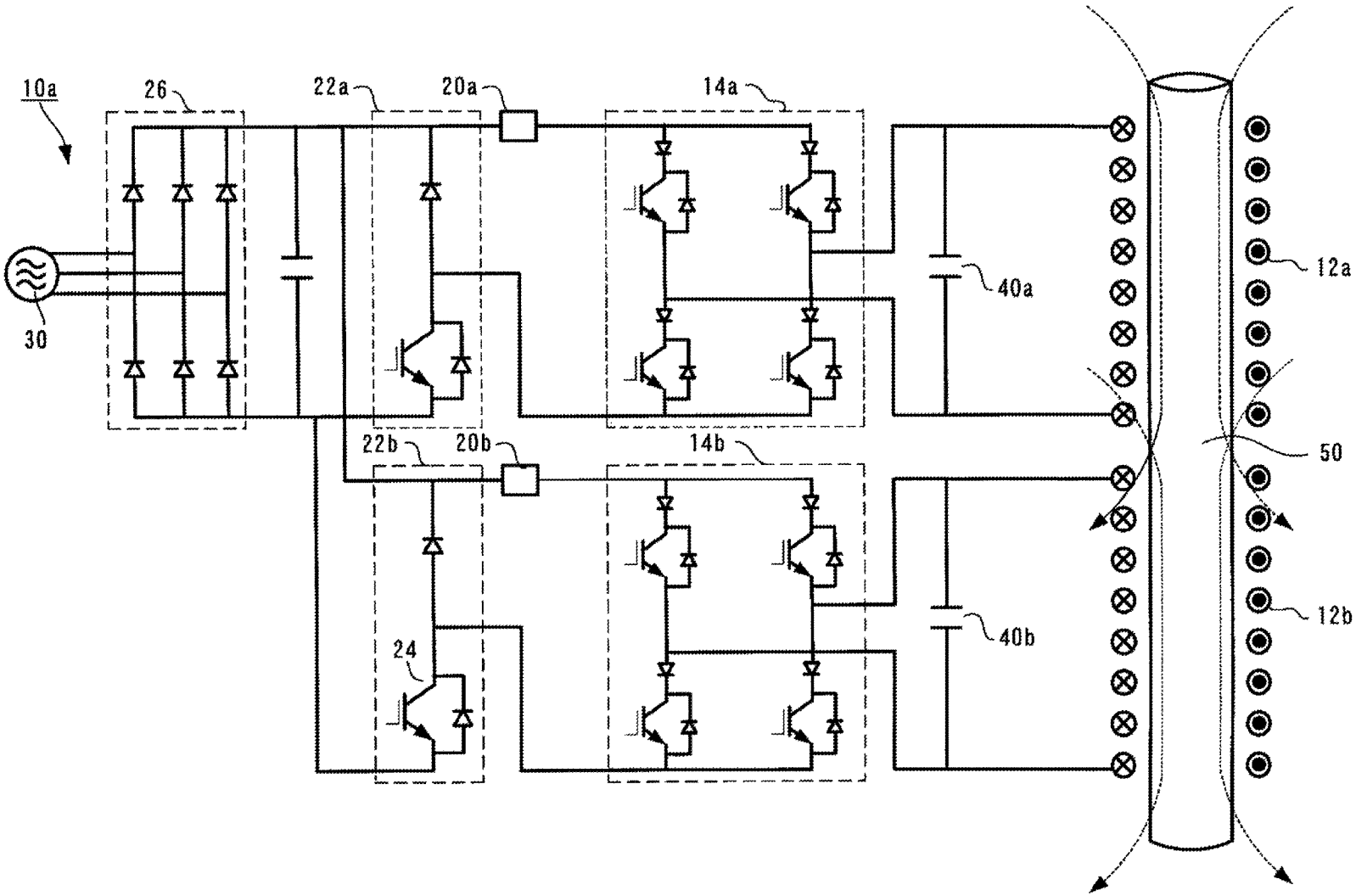
FIG. 11 A diagram showing the configuration of an induction heating device including the self-resonant circuit of the parallel resonant circuit using the current-type inverter.

The induction heating device 10*a* shown in FIG. 11 is almost the same as the induction heating device 10 shown in FIG. 2 but differs from it in that current-type inverters 14*a*1 and 14*b*1 are used and a parallel resonant circuit is formed as the resonant circuit. Hence, portions having the same configurations are identified with the same symbols in the drawing, and their detailed description will be omitted.

Figure 10:
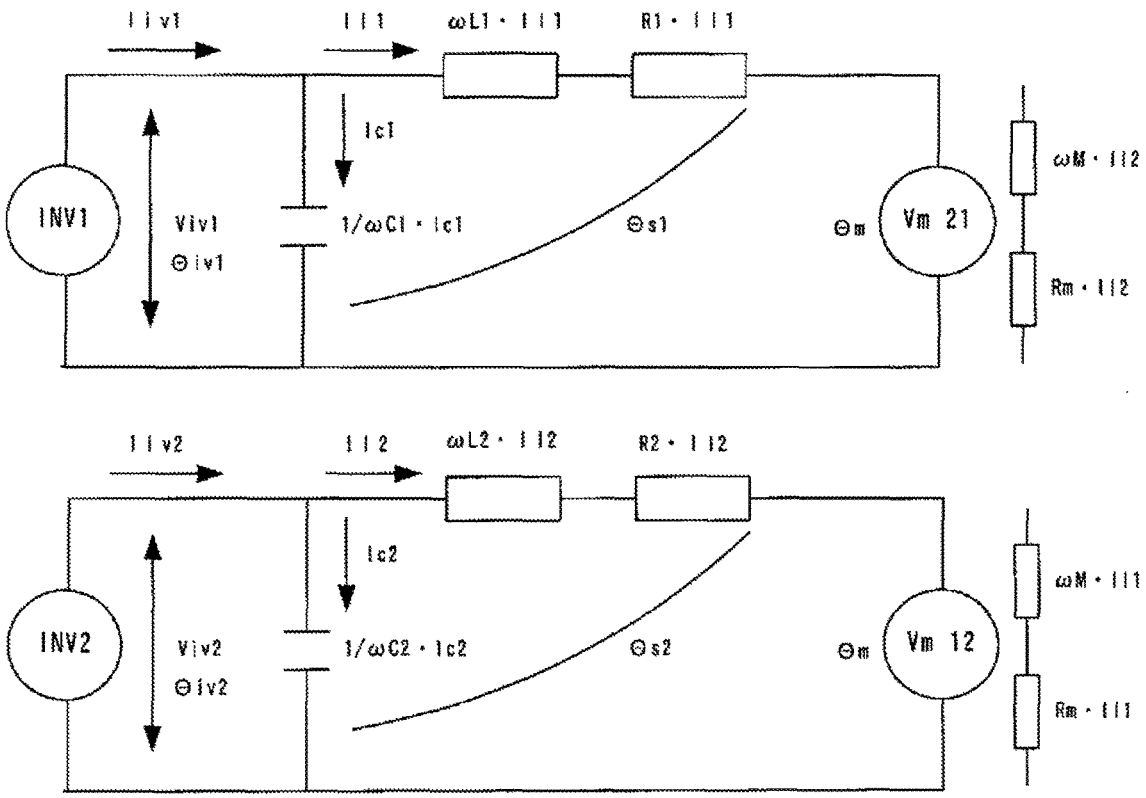
FIG. 10 An equivalent circuit diagram of a self-resonant circuit of a parallel resonant circuit using a current-type inverter.

In the induction heating device 10*a* shown in FIG. 11, the smoothing capacitor 20 provided between the inverters 14*a* and 14*b* and the chopper circuits 22*a* and 22*b* in the induction heating device 10 is omitted, and a DCL 20*a* is arranged. The resonant capacitors 40*a* and 40*b* provided between the inverters 14*a*1 and 14*b*1 and the heating coils 12*a* and 12*b* are arranged parallel to the heating coils 12*a* and 12*b* to form a parallel resonant circuit. Although in FIG. 11 the control circuit, the impedance adjustment means, the current detection means and the voltage detection means are not explicitly shown, their configurations are preferably the same as in the embodiment shown in FIG. 2. The equivalent circuit diagram of the self-resonant circuit shown in FIG. 11 is shown in FIG. 10.

$$Viv2=(Iiv2\times|Z2|+Iiv1\times|Zm|)\times(\cos\Theta+j\sin\Theta) \quad \text{Formula 8}$$

Here, θs1, θs2 and θm are made equal to each other, that is, θs1=θs2=θm=θ, Iiv1 and Iiv2 can be individually expressed by formula 9.

$$Iiv1=\frac{|Viv1|\times(\cos\Theta+j\sin\Theta)-Iiv2\times|Zm|\times(\cos\Theta+j\sin\Theta)}{|Z1|\times(\cos\Theta+j\sin\Theta)} \quad \text{Formula 9}$$

$$Iiv2=\frac{|Viv2|\times(\cos\Theta+j\sin\Theta)-Iiv1\times|Zm|\times(\cos\Theta+j\sin\Theta)}{|Z2|\times(\cos\Theta+j\sin\Theta)}$$

Hence, the gate pulses fed to the inverters are synchronized with each other, and thus the phases of the inverter currents Iiv1 and Iiv2 are synchronized with each other, with the result that the phases of coil currents II1 and II2 can be synchronized with each other. Therefore, even in the self-resonant circuit described above, control or adjustment is performed such that the ratio of the reactance component Zm (=jωM) to the resistance component Rm of the mutual induction impedance (the first ratio) and the ratio of the reactance component Z1 (=jω(L1+Ls1)) to the resistance component R1 of the self-impedance in the self-resonant circuit (the second ratio) are made equal to each other, and thus it is possible to make the phase angles between the coil current and the inverter current equal to each other, with the result that it is possible to synchronize the coil current. Naturally, the phase angle (the first phase angle θm) of the mutual induction voltage Vm21 (Vm12) with respect to the current II2 (II1) supplied to the heating coil is made equal to the phase angle (the second phase angle θ1 (θ2)) of the combination voltage Vs1 (Vs2) in the self-resonant circuit with respect to the current II1 (II2) supplied to the heating coil, and thus it is also possible to make the phase angles between the coil current and the inverter current equal to each other, with the result that it is possible to synchronize the coil current. Since the self-resonant circuit shown in FIG. 11 is the parallel resonant circuit using the current-type inverter, the phase angle is controlled such that the waveform of the current leads in phase with respect to the waveform of the voltage. That is because this makes it possible to perform ZCS control.

Figure 12:
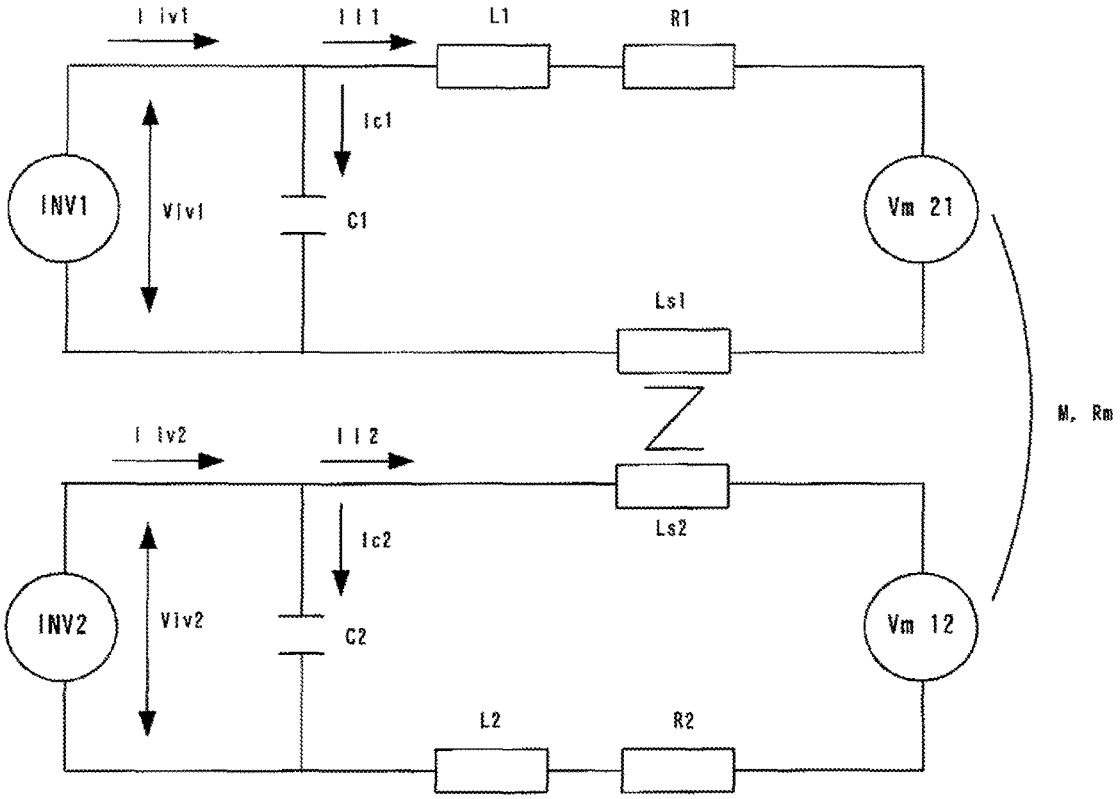
FIG. 12 An equivalent circuit diagram of the self-resonant circuit that forms the parallel resonant circuit using the current-type inverter and that includes a reverse coupling inductance.
Figure 13:
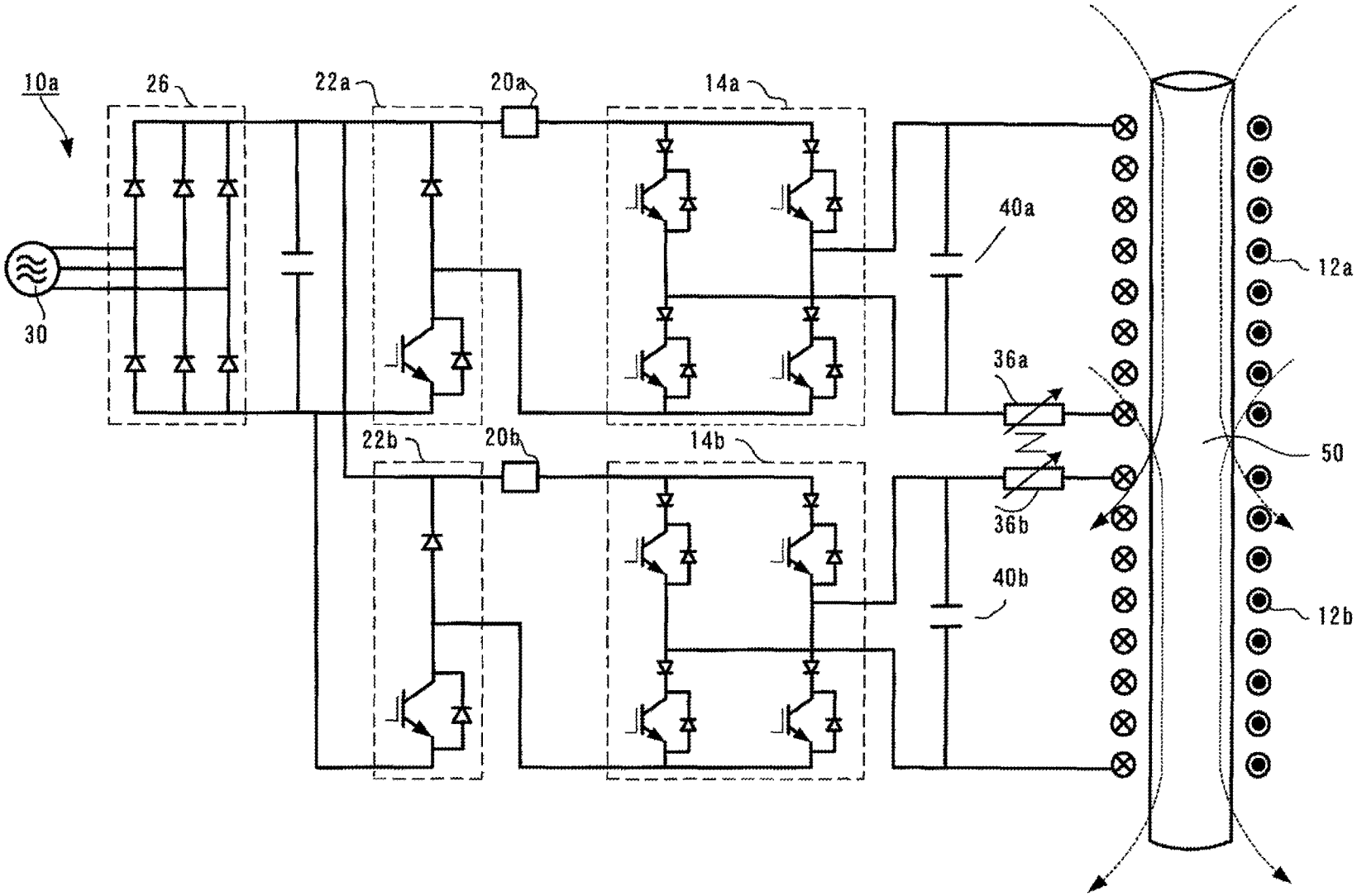
FIG. 13 A diagram showing the configuration of the induction heating device including the self-resonant circuit that forms the parallel resonant circuit using the current-type inverter and that includes the reverse coupling inductance.

Although in the self-resonant circuit shown in FIG. 11, no reverse coupling inductance is provided, as in the case where the voltage-type inverter is used, the present invention can be applied to a circuit where a reverse coupling inductance is provided (FIG. 12: equivalent circuit, FIG. 13: circuit diagram showing an example).

In the embodiment described above, as one of the adjustment, the control and the setting element, the configuration of the phase, the phase angle and the phase difference is taken up, and the description has been given, mainly using the adjustment, control and setting of the angle. However, the phase, the phase angle and the phase difference described above can be represented by the corresponding time, and based on the corresponding time, various types of adjustment, control and setting may be performed.

Specifically, it is possible to determine a time per period by 1/frequency. Since 360° is 27, with respect to the angle θ serving as the adjustment, the control and the setting element, the time per period is divided by the angle θ, and thus it is possible to convert the phase, the phase angle and the phase difference into the corresponding time. This is because the adjustment, the control and the setting can be performed based on the corresponding time instead of the phase, the phase angle and the phase difference.

In the embodiment described above, the detection, the setting and the control of various types of detection, setting and control element such as the output current, the output voltage, the gate pulse and the phase, the phase angle, the phase difference and the like are performed based on the input of the signal to the control circuits 42*a* and 42*b* and the reference signal generation portion 44 and the output of the signal from these elements. However, the detection, the setting and the control described above may be performed, using a computer recording their control data, based on programs (computer programs) recorded in the computer. Moreover, instead of a computer, they may be performed with a medium (programmable device) where data on the detection, the setting, the control and the like is previously recorded for the elements capable of inputting and outputting the control signal. By using the control method described above, it is possible to easily adjust and change the setting value, the control value and the like, and it is also possible to reduce the cost with a common device.

LIST OF REFERENCE SYMBOLS

10: induction heating device, 12*a*: heating coil, 12*b*: heating coil, 14*a*: inverter, 14*b*: inverter, 16: IGBT, 18: diode, 20: smoothing capacitor, 21: smoothing coil, 22*a*: chopper circuit, 22*b*: chopper circuit, 24: IGBT, 25: smoothing capacitor, 26: converter, 28: thyristor, 30: power supply portion, 32*a*: resonant capacitor, 32*b*: resonant capacitor, 34*a*: impedance adjustment means, 34*b*: impedance adjustment means, 36*a*: reverse coupling inductance, 36*b*: reverse coupling inductance, 38*a*: current detection means, 38*b*: current detection means, 40*a*: voltage detection means, 40*b*: voltage detection means, 42*a*: control circuit, 42*b*: control circuit, 44: reference signal generation portion, 50: inductively heated member

The invention claimed is:

1. An induction heating method using an induction heating device that heats an item to be heated and includes a plurality of self-resonant circuits, comprising the steps of:

supplying currents of equal frequency via a resonant high frequency power supply to a plurality of heating coils receiving the supply of the current to generate mutual induction;

performing adjustment or control such that a first ratio of a reactance component of a mutual induction impedance to a resistance component of the mutual induction impedance between the adjacent self-resonant circuits and a second ratio of a reactance component of a self-impedance to a resistance component of the self-impedance in the self-resonant circuit are made equal to each other.

2. The induction heating method of claim 1, wherein the adjustment or the control performed such that the first ratio and the second ratio are made equal to each other is carried out by adjustment or control on the impedance of the self-resonant circuit.

3. The induction heating method of claim 1, wherein the adjustment or the control performed such that the first ratio and the second ratio are made equal to each other is carried out by adjustment or control on the frequency of the current supplied to the heating coil.

4. The induction heating method of claim 1, wherein when a gate pulse is supplied to the resonant high-frequency power supply in each of the self-resonant circuits, the gate pulse is output such that a phase difference of the gate pulse is zero or close to a predetermined phase difference, and the induction heating device is operated.

5. The induction heating method of claim 1, wherein the resonant high-frequency power supply in each of the self-resonant circuits is a voltage-type high-frequency power supply, and the induction heating device is operated such that a phase difference of an output current of the voltage-type high-frequency power supply is zero.

6. The induction heating method of claim 1, wherein the resonant high-frequency power supply in each of the self-resonant circuits is a current-type high-frequency power supply, and the induction heating device is operated such that a phase difference of an output voltage of the current-type high-frequency power supply is zero.

7. The induction heating method of claim 4, wherein the gate pulse is output such that when the resonant high-frequency power supply is started up, a phase difference of the gate pulse is zero or close to a predetermined phase difference, and thereafter, the gate pulse supplied to the resonant high-frequency power supply is controlled such that a phase of the current supplied to each of the heating coils is made to coincide with a phase of a reference signal.

8. The induction heating method of claim 7, wherein when the resonant high-frequency power supply is started up such that the phase difference of the gate pulse is zero, the gate pulse is controlled so as to have a predetermined phase or a time corresponding to the phase with respect to a current synchronization reference position determined based on the reference signal.

9. The induction heating method of claim 8, wherein after the starting up of the resonant high-frequency power supply, a zero-crossing position of the current supplied to each of the heating coils is detected, and when the zero-crossing position of each current is displaced from the current synchronization reference position, the gate pulse position is controlled such that a phase difference between the zero-crossing position of each current and the current synchronization reference position is zero.

10. The induction heating method of claim 9, wherein a permissible phase angle range which is a permissible range of a phase angle between the output voltage and the output current is determined, and the frequency and/or a value of the output current is controlled such that the phase angle between the output voltage and the output current falls within the permissible phase angle range.

11. The induction heating method of claim 10, wherein while the frequency is being controlled, the gate pulse position is controlled such that a phase difference between the currents is zero.

12. The induction heating method of claim 10, wherein the frequency is controlled within a range of values higher than a resonant frequency of the self-resonant circuit.

13. The induction heating method of claim 9, wherein a current synchronization control range limiter which is a limit range of a phase difference between the gate pulse position and the current synchronization reference position is determined, and the output current is controlled such that the gate pulse position falls within a range of the current synchronization control range limiter.

14. The induction heating method of claim 1, wherein a reverse coupling inductance is connected to each of electricity feed lines to the heating coils which are arranged adjacently to generate mutual induction by the supply of the current so that the first ratio is reduced.

15. The induction heating method of claim 14, wherein a reactance component of the reverse coupling inductance is adjusted or controlled such that the first ratio and the second ratio are made equal to each other.

16. The induction heating method of claim 15, wherein the first ratio is adjusted to be equal to a predetermined target value, and the second ratio is made equal to the target value.

17. The induction heating method of claim 16, wherein the reactance component of the mutual induction impedance is varied by varying a coupling coefficient in the reverse coupling inductance so that the first ratio is adjusted.

18. The induction heating method of claim 1, wherein the inductance or the capacitance in the self-resonant circuit is adjusted so that the second ratio is adjusted.

19. The induction heating method of claim 1, wherein the detection, the setting and the control are performed through a computer program or a programmable device.

* * * * *